US007342051B2

(12) United States Patent
Janse Van Vuuren

(10) Patent No.: US 7,342,051 B2
(45) Date of Patent: Mar. 11, 2008

(54) INTRODUCTION OF AN ACID IN A FISCHER-TROPSCH PROCESS

(75) Inventor: Matthys Josephus Janse Van Vuuren, Sasolburg (ZA)

(73) Assignee: Sasol Technologoy (PTY) Limited, Johannesburg (ZA)

( * ) Notice: Subject to any disclaimer, the term of this patent is extended or adjusted under 35 U.S.C. 154(b) by 0 days.

(21) Appl. No.: 11/583,038

(22) Filed: Oct. 19, 2006

(65) Prior Publication Data

US 2007/0100004 A1 May 3, 2007

Related U.S. Application Data

(60) Provisional application No. 60/728,314, filed on Oct. 20, 2005.

(51) Int. Cl.
*C07C 27/00* (2006.01)

(52) U.S. Cl. ..... 518/719; 518/717

(58) Field of Classification Search ..... 518/717, 518/719

See application file for complete search history.

(56) References Cited

OTHER PUBLICATIONS

Abstract of RU 2261241, Chemical Abstract, 2005.*

* cited by examiner

*Primary Examiner*—J. Parsa
(74) *Attorney, Agent, or Firm*—Finnegan, Henderson, Farabow, Garrett, & Dunner, L.L.P.

(57) ABSTRACT

A three-phase low temperature Fischer-Tropsch (LTFT) process wherein CO and $H_2$ are converted to hydrocarbons and possibly oxygenates thereof by contacting the CO and $H_2$ with an iron-based Fischer-Tropsch catalyst in a LTFT reactor in the presence of an acid which is introduced into the LTFT reactor.

9 Claims, 1 Drawing Sheet

Figure 1: The $CO_2$ selectivity of the acetic acid
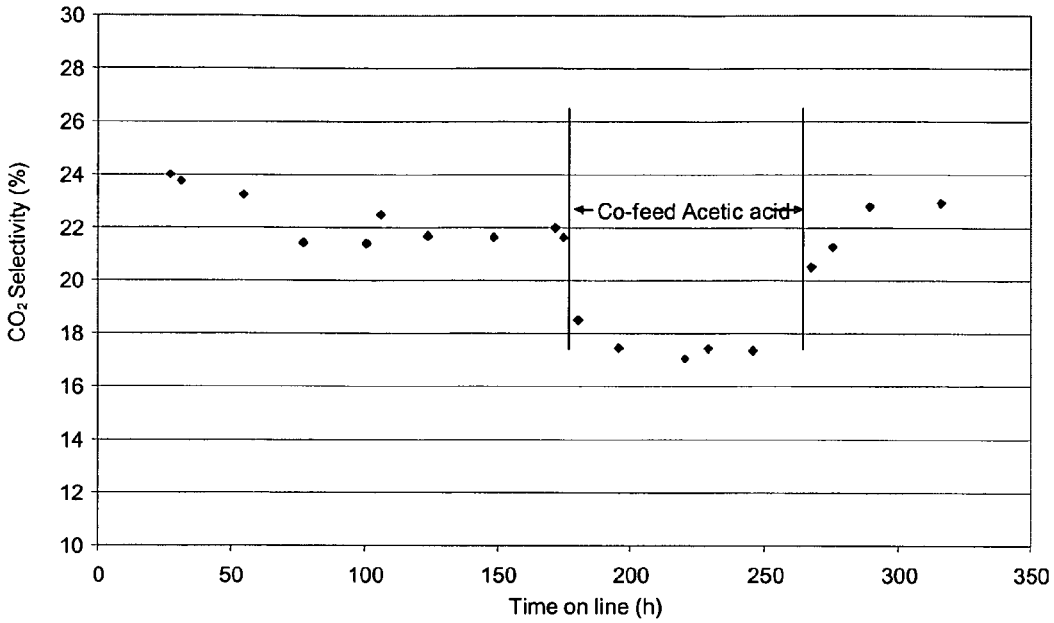
$CO_2$ selectivity is expressed as mol $CO_2$ produced/mol CO converted
Figure 2: Change in $CO_2$ selectivity by varying the acid concentration of various acids in feed during FTS
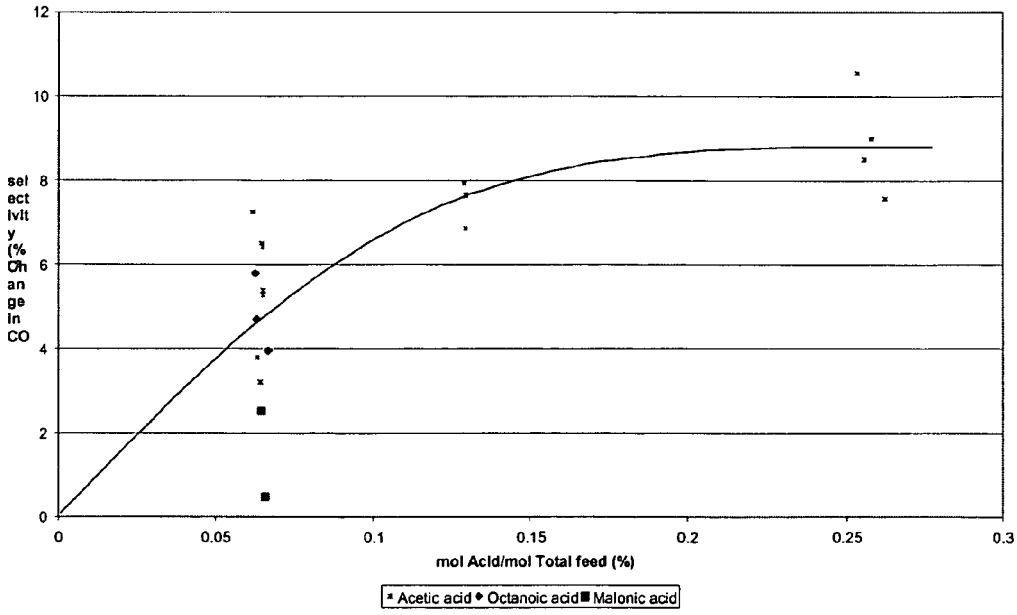

INTRODUCTION OF AN ACID IN A FISCHER-TROPSCH PROCESS

CROSS REFERENCE TO RELATED APPLICATION

This application claims the benefit of U.S. Provisional Application No. 60/728,314, filed Oct. 20, 2005, content of which is incorporated herein by reference.

FIELD OF THE INVENTION

This invention relates to a Fischer-Tropsch (FT) process wherein an acid is introduced.

BACKGROUND TO THE INVENTION

A FT process comprises the hydrogenation of CO in the presence of a catalyst based on metals, such as Fe, Co and Ru. The products formed from this reaction are usually gaseous, liquid and waxy hydrocarbons which may be saturated or unsaturated. Oxygenates of the hydrocarbons such as alcohols, acids, ketones and aldehydes are also formed. The carbon number distribution of the products follow the well-known Anderson-Schulz-Flory distribution.

A heterogeneous Fisher-Tropsch process may be conveniently categorised as either a high temperature Fischer-Tropsch (HTFT) process or a low temperature Fischer-Tropsch (LTFT) process. The HTFT process can be described as a two phase Fischer-Tropsch process. It is usually carried out at a temperature from 250° C. to 400° C. and the catalyst employed is usually an iron-based catalyst.

The LTFT process can be described as a three phase Fischer-Tropsch process. It is usually carried out at a temperature from 220° C. to 310° C. and the catalyst employed is usually either a Co-based catalyst or a Fe-based catalyst. The conditions under which this process is carried out, results in the products being in a liquid and possibly also in a gas phase in the reactor. Therefore this process can be described as a three phase process, where the reactants are in the gas phase, at least some of the products are in the liquid phase, and the catalyst is in a solid phase in the reaction zone. Generally this process is commercially carried out in a fixed or fluidized bed reactor or a slurry bed reactor.

During FT synthesis (FTS) another reaction, namely the water gas shift (WGS) reaction usually also takes place. The WGS reaction is as follows:

$$H_2O+CO \leftrightarrow CO_2+H_2$$

The WGS reaction is not a desired reaction in FTS where the $H_2/CO$ molar feed ratio is high, that is above the stoichiometric ratio required for the products to be formed. This is due to the fact that during the WGS reaction CO is converted to unwanted $CO_2$ compared to FTS where CO is converted to hydrocarbons. It will also be appreciated that $CO_2$ production creates environmental problems.

The WGS reaction is especially problematic in a LTFT process in the presence of a Fe-based catalyst, as these reactions are usually carried out between 220 to 270° C. Under these conditions the WGS reaction is not under equilibrium and no effective reverse WGS takes place with the result that $CO_2$ is not converted back to CO within the LTFT reactor.

It has been observed that during FTS, the WGS activity of a FT catalyst increases over time and an increase in $CO_2$ selectivity is accordingly also observed.

It has also been observed now, that with an increase in WGS activity (and accordingly $CO_2$ production) acid production increases. Furthermore, it has been also observed that with increased acid production a lesser degree of olefin isomerisation (internal double bonds/total double bonds) takes place.

In the light of the above it was expected that the addition of an acid to FTS would increase $CO_2$ production and reduce olefin isomerisation. However, it was most surprisingly found that the addition of an acid to FTS in fact resulted in a decrease in $CO_2$ selectivity, a decrease in acid selectivity (in at least some cases) and in at least some cases little or no change in olefin isomerisation.

The applicant is not aware of any prior art wherein an acid had been introduced in FTS. This is not surprising as the production of acids via FTS is a major problem. The acids may cause corrosion of mild steel and may cause deactivation and corrosion of hydrotreating catalysts in the downstream refinery. Carboxylates may also cause bed plugging on hydrotreating catalysts. In addition, strict specifications on the acid content of commercial fuels exist.

DISCLOSURE OF THE INVENTION

According to a first aspect of the present invention there is provided a three-phase low temperature Fischer-Tropsch (LTFT) process wherein CO and $H_2$ are converted to hydrocarbons and possibly oxygenates thereof by contacting the CO and $H_2$ with an iron-based Fischer-Tropsch catalyst in a LTFT reactor in the presence of an acid which is introduced into the LTFT reactor.

According to a second aspect of the present invention there is provided the introduction of an acid into a low temperature Fischer-Tropsch (LTFT) reactor wherein CO and $H_2$ are converted to hydrocarbons and possibly oxygenates thereof by contacting the CO and $H_2$ with an iron-based Fischer-Tropsch catalyst under three phase LTFT process conditions.

Preferably the acid is introduced in order to decrease $CO_2$ production in the reactor. Alternatively or additionally the introduced acid may decrease the acid production in the reactor.

Acid Introduction

Preferably the introduced acid is an organic acid, preferably an oxoacid, preferably a carboxylic acid. The acid may include one or more carboxyl groups. The acid may comprise a $C_1$ to $C_{10}$ carboxylic acid with one or more carboxyl groups. The acid may also comprise a di-acid such as malonic acid, oxalic acid or a natural acid such as citric acid. In one embodiment of the invention the carboxylic acid may comprise acetic acid or octanoic acid, preferably acetic acid. The introduced acid may comprise a mixture of acids, such as acetic acid mixed with one or more other organic acids.

In one embodiment of the invention the introduced acid may comprise one or more acids produced by the LTFT process, and such one or more acids may be recycled to the LTFT reactor after separation from products of the LTFT process. Shorter chain acids and acetic acid produced during the LTFT process will report in a water fraction produced by the LTFT process and usually acetic acid will be the most dominant acid. Typically, liquid-liquid extraction can be used to recover the one or more acids from the water fraction, and part of these recovered acids may be recycled to the LTFT reactor to be introduced acid.

The introduced acid may be mixed with a suitable carrier, especially to allow the acid to be introduced in diluted form into the reactor. The carrier may comprise an organic compound, preferably a solvent of the introduced acid. Preferably the carrier comprises one or more organic compounds produced during the LTFT process, for example gaseous, liquid and waxy hydrocarbons which may be saturated or unsaturated, oxygenates of the hydrocarbons such as alcohols, acids, ketones and aldehydes. Preferably the carrier is a liquid hydrocarbon. In one embodiment of the invention the carrier may comprise an alkane, preferably a non-branched alkane, preferably n-octane. Alternatively it may be a compound such as acetone.

In use the carrier will be used to control the acid feed rate to the LTFT reactor.

The introduced acid may be provided at any suitable concentration.

In a preferred embodiment of the invention the introduced acid is kept under an inert gas atmosphere to keep oxygen out. The inert gas may be any suitable gas, but preferably it comprises a nobel gas such as argon.

The introduced acid may be fed at any suitable rate, preferably from 0.001 to 1 mol % acid per total mol feed, more preferably from 0.005 to 0.5 mol % acid per total mol feed, most preferably from 0.01 to 0.25 mol % acid per total mol feed. In one embodiment of the invention the acid may be fed at 0.065 mol % acid per total mol feed and the flow rate of feed over the catalyst may be 6200 (ml(n)/g cat/h), but it may range from 2000 to 12000 (ml(n)/g cat/h). The feed rate of the acid may be at a rate 3 times the production rate of the produced acid.

Fischer-Tropsch Catalyst

The Fischer-Tropsch catalyst may be any suitable iron-based catalyst. The catalyst may be a fused catalyst, alternatively it may be a precipitated catalyst. The catalyst may be prepared according to conventional or known methods.

The catalyst may include one or more catalyst promoters such as one or more alkali-metal based promoters and/or one or more alkaline earth based promoters. One or more other promoters may also be included in the catalyst. A metal promotor, such as Cu may be included in the catalyst.

The catalyst may also include one or more different supports.

LTFT Process

The LTFT process is a three-phase LTFT process wherein, under reaction conditions, the reactants are in a gas phase, at least some of the products are in a liquid phase and the catalyst is in a solid phase.

Preferably the LTFT reactor is a slurry bed reactor or fixed bed reactor. Preferably the reactor is a slurry bubble column reactor.

The process may be carried out at a pressure above atmospheric pressure, preferably from $1\times10^6$ to $10\times10^6$ Pa, preferably from $2\times10^6$ to $8\times10^6$ Pa.

The process may be carried out at a temperature above 150° C., preferably from 210° C. to 310° C., preferably from 220° C. to 270° C., typically from 230° C. to 255° C.

The $H_2$:CO molar ratio may be between 2.5 and 1, preferably it is 1.5.

The feed comprises of $H_2$ and CO and it may be mixed with other gases such as $CO_2$, $N_2$ and $CH_4$ in the conventional manner.

The invention will now be further described by means of the following non limiting examples:

EXAMPLE 1

1. Catalyst Preparation

A high surface area precipitated iron FT catalyst containing Fe, $SiO_2$, Cu and K was used. Loadings of 25 g $SiO_2$, 5 g Cu and 5 g $K_2O$/100 Fe were used.

2. Preparation of Acid Solution

Glacial acetic acid was dissolved in n-octane to provide a 5 mass % acid/octane mixture. The mixture was kept under an argon blanket to keep oxygen out.

3. LTFT Synthesis 3.1 Analysis Used:

Acid numbers were determined with an acid base titration (KOH) using phenolphthalein as indicator. Analysis was limited to the water fraction as more than 90% by mass of the acid reports in the water phase.

The acid group selectivity was expressed as the selectivity of acid groups (COOH) as function of total carbon from FTS.

3.2 Synthesis

Activation of the catalyst was done with synthesis gas (feed gas) ($H_2$/CO (mol/mol)=1.5) at 240° C. and 2000 kPa for 16 hours at a gas hourly space velocity (GHSV) of 6400 Nml/g cat/h.

FTS was carried out in a continuous stirred tank reactor and two knock out pots (200° C. for wax and 25° C. for oil and water) were used. FTS was done using a $H_2$/CO molar feed ratio of 1.5 at 2650 kPa and 245° C.

The product selectivity was determined over a period of 150 hours. The synthesis gas conversion was kept at ~35 mass % by correcting the feed gas flow rate. The gas hour space velocity (GHSV) was changed to obtain a (CO +$CO_2$) conversion of 35%. 10% Argon was co-fed as an inert tracer to determine conversion and contraction.

After FTS performance was determined, the influence of co-feeding (introducing) an organic acid to the FTS reactor was studied. The glacial acetic acid dissolved in n-octane was co-fed (introduced) by means of a HPLC pump to the FT reactor at a rate of $2.1\times10^{-3}$ mol/h acetic acid. The co-fed acetic acid was 0.065 mol % of the total feed to the reactor. This was about 3 times the production rate of acids as measured by acid determination in the water phase of the FT product. After 173 hours of normal FT synthesis, the co-feeding of the acetic acid/n-octane was commenced and was stopped at 246 hours where after normal FTS was continued.

BRIEF DESCRIPTION OF DRAWINGS

The results are provided in FIG. 1 and Tables 1 and 2

TABLE 1

| Time on Line (h) | Acid co-fed (mol/h) | Apparent acid group selectivity (mol COOH/mol CO to FT) | Acid production rate mol COOH/h | Acid group selectivity (mol COOH/mol CO to FT) | $CO_2$ selectivity (Of total CO reacted) |
|---|---|---|---|---|---|
| 54.8 | 0 | 0.001694 | 0.000991 | 0.001694 | 23.23 |
| 77.2 | 0 | 0.001454 | 0.000896 | 0.001454 | 21.45 |
| 100.8 | 0 | — | — | — | 21.39 |
| 106.2 | 0 | — | — | — | 22.49 |
| 124.0 | 0 | 0.00217 | 0.001207 | 0.00217 | 21.67 |
| 148.6 | 0 | — | — | — | 21.63 |
| 171.8 | 0 | 0.00207 | 0.000984 | 0.00207 | 21.98 |
| 175.1 | 0.002104 | — | — | — | 21.62 |
| 180.5 | 0.002104 | — | — | — | 18.52 |

TABLE 1-continued

| Time on Line (h) | Acid co-fed (mol/h) | Apparent acid group selectivity (mol COOH/mol CO to FT) | Acid production rate mol COOH/h | Acid group selectivity (mol COOH/mol CO to FT) | $CO_2$ selectivity (Of total CO reacted) |
|---|---|---|---|---|---|
| 196.0 | 0.002104 | 0.004513 | 4.76E−05 | 9.98E−05 | 17.45 |
| 220.8 | 0.002104 | 0.005692 | 0.000552 | 0.001183 | 17.05 |
| 229.4 | 0.002104 | 0.006428 | 0.000596 | 0.00142 | 17.41 |
| 246.0 | 0.002104 | 0.006905 | 0.00066 | 0.001649 | 17.36 |
| 267.6 | 0 | 0.002222 | 0.000892 | 0.002222 | 20.51 |
| 275.5 | 0 | 0.001949 | 0.000784 | 0.001949 | 21.27 |
| 289.3 | 0 | 0.002022 | 0.000722 | 0.002022 | 22.78 |
| 316.2 | 0 | 0.002057 | 0.000694 | 0.002057 | 22.94 |

In Table 1, "Apparent acid group selectivity" is expressed as the total acid as analysed by acid base titration ((acid co-fed+acid produced)/CO to FT). The "Acid production rate" is the total acid analysed minus acid co-fed. "Acid group selectivity" is the mol acid produced per mol CO converted to FT products.

TABLE 2

| Time on Line (h) | Acid co-fed (mol/h) | H2/CO-Feed Ratio (mol/mol) | H2/CO-Reactor Ratio (mol/mol) | Usage Ratio (Delta H2/Delta CO) |
|---|---|---|---|---|
| 54.7 | 0 | 1.50 | 1.57 | 1.34 |
| 77.2 | 0 | 1.49 | 1.56 | 1.35 |
| 100.7 | 0 | 1.52 | 1.57 | 1.41 |
| 106.2 | 0 | 1.53 | 1.63 | 1.35 |
| 124.0 | 0 | 1.53 | 1.62 | 1.37 |
| 148.6 | 0 | 1.53 | 1.61 | 1.37 |
| 171.8 | 0 | 1.48 | 1.57 | 1.34 |
| 175.1 | 0.002104 | 1.49 | 1.57 | 1.35 |
| 180.5 | 0.002104 | 1.51 | 1.54 | 1.46 |
| 201.5 | 0.002104 | 1.50 | 1.50 | 1.53 |
| 220.8 | 0.002104 | 1.52 | 1.51 | 1.55 |
| 229.4 | 0.002104 | 1.51 | 1.54 | 1.45 |
| 246.0 | 0.002104 | 1.50 | 1.52 | 1.43 |
| 267.6 | 0 | 1.50 | 1.55 | 1.35 |
| 275.5 | 0 | 1.55 | 1.56 | 1.52 |
| 289.3 | 0 | 1.49 | 1.53 | 1.40 |
| 316.2 | 0 | 1.48 | 1.54 | 1.31 |

It is clear from Table 1 that the introduction of the acid in the LTFT process resulted in decreased $CO_2$ and acid production.

It was also found that double bond isomerisation was not influenced by the acid addition in the FT reactor.

It is clear from the above that $CO_2$ production can be manipulated by the introduction of acid in the LTFT process. When the acid is introduced the $CO_2$ production drops, and the $CO_2$ production increases again when the acid co-feeding is stopped. The co-feeding of acetic acid results in a decrease in $H_2$/CO reactor ratio and therefore also results in decreased $H_2$/CO usage ratio.

The results have also shown that the introduced acid does not enhance de-activation of the iron-based catalyst.

The introduced acid does not leach metal from the FT catalyst as no colour change of the produced wax was observed during and after acid co-feeding was commenced. ICP analysis of the wax also showed that the iron level in the wax was below 2 ppm.

EXAMPLE 2

1. Catalyst Preparation

The same catalyst as mentioned in Example 1 was used.

2. Preparation of Acid Solution

Glacial acetic acid was dissolved in n-octane to render a 7.23 mass % acetic acid in octane. The mixture was kept under an argon blanket to keep oxygen out.

3. LTFT Synthesis

Activation of the catalyst and FTS were carried out in the same manner as described in Example 1.

After FTS performance was determined, the influence of co-feeding (introducing) an organic acid at different acid concentrations to the FTS reactor was studied. The glacial acetic acid dissolved in n-octane was co-fed (introduced) after 125 hours time on line by means of a HPLC pump to the FT reactor, at a rate of $2.1\times10^{-3}$ mol/h acetic acid. The co-fed acetic acid was 0.062 mol % of the total feed to the reactor, whereafter the concentration was increased subsequently to 0.12 mol % acid per total mol feed after 199 hours and 0.25 mol % acid per total mol feed after 230 hours. Co-feeding (introducing) of the acetic acid/n-octane mixture was stopped after 269 hours time on line and normal FTS was continued.

The results are shown in FIG. 2.

EXAMPLE 3

1. Catalyst Preparation

The same catalyst as mentioned in Example 1 was used.

2. Preparation of Acid Solution

Octanoic acid was dissolved in n-octane to provide a 6.16 mass % octanoic acid in octane mixture. The mixture was kept under an argon blanket to keep oxygen out.

3. LTFT Synthesis

Activation of the catalyst and FTS were carried out in the same manner as described in Example 1.

After FTS performance was determined for 211 hours, the octanoic acid dissolved in n-octane was co-fed (introduced) by means of a HPLC pump to the FT reactor at a rate of $2.1\times10^{-3}$ mol/h octanoic acid. The co-fed (introduced) octanoic acid was approximately 0.065 mol % of the total feed to the reactor. Co-feeding (introduction) of the octanoic acid/n-octane mixture was stopped after 260 hours time on line and normal FTS was continued.

The results are shown in FIG. 2.

EXAMPLE 4

1. Catalyst Preparation

The same catalyst as mentioned in Example 1 was used.

2. Preparation of Acid Solution

Malonic acid was dissolved in acetone to give a 5 mass % acid in acetone mixture. The mixture was kept under an argon blanket to keep oxygen out.

3. LTFT Synthesis

Activation of the catalyst and FTS were carried out in the same manner as described in Example 1.

The effect of co-feeding (introducing) an organic di-acid to the FT reactor was investigated. After FTS performance was determined, the malonic acid/acetone mixture was co-fed (introduced) to FT reactor after 130 hours time on line by means of a HPLC pump at a rate of $2.1\times10^{-3}$ mol/h malonic acid.

The results are shown in FIG. 2.

The effect of co-feeding (introducing) various mono- and di-carboxylic acids, such as acetic acid, octanoic acid and malonic acid, as well as different acetic acid concentrations, on FTS was investigated. FIG. 2 illustrates the change in $CO_2$ selectivity at different acid concentrations for the various acids. An increase in acid concentration renders an accelerated decrease in $CO_2$ selectivity where after a maximum decrease in $CO_2$ selectivity is obtained at a certain acid concentration, approximate 0.22 mol % acid per mol total feed for this specific catalyst. Similar behavior on the change in $CO_2$ selectivity is observed for the different mono-carboxylic acids while the effect was less prominent for the di-acid. A possible reason for latter is that malonic acid easily undergoes decarboxylation above 140° C. to form acetic acid. Therefore the reduction in $CO_2$ selectivity will be less using malonic acid.

The invention claimed is:

1. A three-phase low temperature Fischer-Tropsch (LTFT) process comprising converting CO and $H_2$ to hydrocarbons and possibly oxygenates thereof by contacting the CO and $H_2$ with an iron-based Fischer-Tropsch catalyst in a LTFT reactor in the presence of an organic acid which is introduced into the LTFT reactor separately to and distinct from the iron-based Fischer-Tropsch catalyst.

2. The process of claim 1 wherein the introduced acid is an oxoacid.

3. The process of claim 2 wherein the introduced acid includes one or more carboxyl groups.

4. The process of claim 3 wherein the acid is a $C_1$ to $C_{10}$ carboxylic acid with one or more carboxyl groups.

5. The process of claim 1 wherein the introduced acid is mixed with a suitable carrier.

6. The process of claim 5 wherein the carrier is an organic compound in the form of a solvent of the introduced acid.

7. The process of claim 1 wherein the introduced acid is fed at a rate from 0.0001 to 1 mol % acid per total mol feed.

8. The process of claim 7 where the rate is from 0.01 to 0.25 mol % acid per total mol feed.

9. The process of claim 1 wherein the LTFT reactor is a slurry bubble column reactor.

* * * * *